US006734774B2

(12) United States Patent
Yeh et al.

(10) Patent No.: US 6,734,774 B2
(45) Date of Patent: May 11, 2004

(54) IGNITION COIL

(75) Inventors: Ming Yeh, Taipei Hsien (TW); Heng Cheng Chou, Taipei Hsien (TW); Chen-Feng Wu, Taoyuan (TW); Chien-Chia Lin, Taoyuan (TW)

(73) Assignee: Delta Electronics Inc., Taoyuan Sien (TW)

( * ) Notice: Subject to any disclaimer, the term of this patent is extended or adjusted under 35 U.S.C. 154(b) by 0 days.

(21) Appl. No.: 09/984,398

(22) Filed: Oct. 30, 2001

(65) Prior Publication Data

US 2002/0050904 A1 May 2, 2002

(30) Foreign Application Priority Data

Oct. 31, 2000 (TW) ..... 89218850 U

(51) Int. Cl.[7] ..... H01F 27/30
(52) U.S. Cl. ..... 336/192; 336/198
(58) Field of Search ..... 336/65, 90, 92, 336/96, 192, 107, 198

(56) References Cited

U.S. PATENT DOCUMENTS 4,041,430 A * 8/1977 Hrynewycz ..... 336/92
4,683,518 A * 7/1987 Gwozdz ..... 336/183
4,924,200 A * 5/1990 Kitahara et al. ..... 336/65
5,179,365 A * 1/1993 Raggi ..... 336/65

* cited by examiner

*Primary Examiner*—Tuyen T. Nguyen
(74) *Attorney, Agent, or Firm*—Birch, Stewart, Kolasch & Birch, LLP

(57) ABSTRACT

An ignition coil is provided. The ignition coil comprises a casing, a plurality of pins and a bobbin. The pins are disposed inside the casing. The bobbin, having a plurality of first terminals corresponding to the pins respectively, is disposed inside the casing. Each of the first terminals is provided with a ring-shaped portion in contact with the corresponding pin. Hence, resin, filled in the ignition coil, is prevented from leaking out of the casing.

12 Claims, 3 Drawing Sheets

IGNITION COIL

BACKGROUND OF THE INVENTION

1. Field of the Invention

The invention relates to an ignition coil; in particular, the invention relates to an ignition coil that can prevent filled resin from leaking.

2. Description of the Related Art

An ignition coil ignites combustible gas by high voltage. Referring to FIG. 1*a*, a conventional ignition coil 10 comprises a casing 20, a bobbin 30, a primary coil (not shown), at least one secondary coil (not shown), a circuit (not shown) and a bar core 70. The casing 20 is made of plastic.

The bobbin 30 is disposed inside the casing 20, as shown in FIG. 1*a*. The bobbin 30 is provided with a primary portion 50 and two secondary portions 60. The primary portion 50 separates the secondary portions 60 by partitions. The primary portion 50 is provided with two terminals 51. Each of the secondary portions 60 is provided with two pins 62.

The primary coil surrounds the primary portion 50 and is electrically connected to the terminals 51. One end of the secondary coil attaches to one of the pins 62, and the other end of the secondary coil attaches to the other pin 62 by solder.

The bar core 70 penetrates the bobbin 30 to provide a magnetic route. The circuit converts a DC voltage to a triggering-voltage signal. The triggering-voltage signal inputs to the primary coil. By the voltage conversion of the primary coil and the secondary coil, the D.C. voltage is converted to a high voltage. The high voltage ignites the combustible gas through the pins 62 in a tip-discharging manner.

The casing 20 is filled with a resin such as an epoxy resin so as to prevent high voltage, as generated by the coil portion, from leaking out of the casing 20 and a dielectric breakdown from being caused in the ignition coil by the high voltage.

FIG. 1*b* is an enlarged view of the pins 62 in FIG. 1*a*. During assembly, the pins 62 must pass through holes 25, formed in the casing 20, to expose their tips. As a result, the filled resin can leak out of the casing 20 through the holes 25. Accordingly, a design in which the diameter of the hole 25 is smaller than the diameter of the pin 62 is provided. However, in such design, the wire (not shown), attached to the pin 62, is easily broken when the pin 62 passes through the hole 25, is because the size of the pin 62 is bigger than that of the hole 25 so that the pin 62 is easily squeezed out of the hole and then the wire is twitched by the squeezed pin 62.

Therefore, it is desirable to develop an ignition coil that can prevent the attached wire from breaking and prevent filled resin from leaking while assembling.

SUMMARY OF THE INVENTION

In order to address the disadvantages of the aforementioned ignition coil, the invention provides an ignition coil that can prevent filled resin from leaking.

Another purpose of this invention is to provide an ignition coil that can prevent the attached wire from breaking.

Accordingly, the ignition coil of this invention comprises a casing, a plurality of pins and a bobbin. The pins are disposed inside the casing. The bobbin, having a plurality of terminals corresponding to the pins respectively, is disposed inside the casing. Each of the terminals is provided with a ring-shaped portion in contact with the corresponding pin.

Furthermore, each of the ring-shaped portions surrounds the corresponding pin so as to be in contact with the corresponding pin.

Furthermore, each of the terminals is provided with a protruding portion. The bobbin is provided with a primary portion and at least one secondary portion, and the terminals are formed on the secondary portion. The primary portion is provided with another two terminals.

Furthermore, the ignition coil comprises a core disposed inside the bobbin. The casing is made of plastic, and each of the pins is made of metal.

BRIEF DESCRIPTION OF THE DRAWINGS

The invention is hereinafter described in detail with reference to the accompanying drawings in which.

DETAILED DESCRIPTION OF THE INVENTION

Figure 1A:
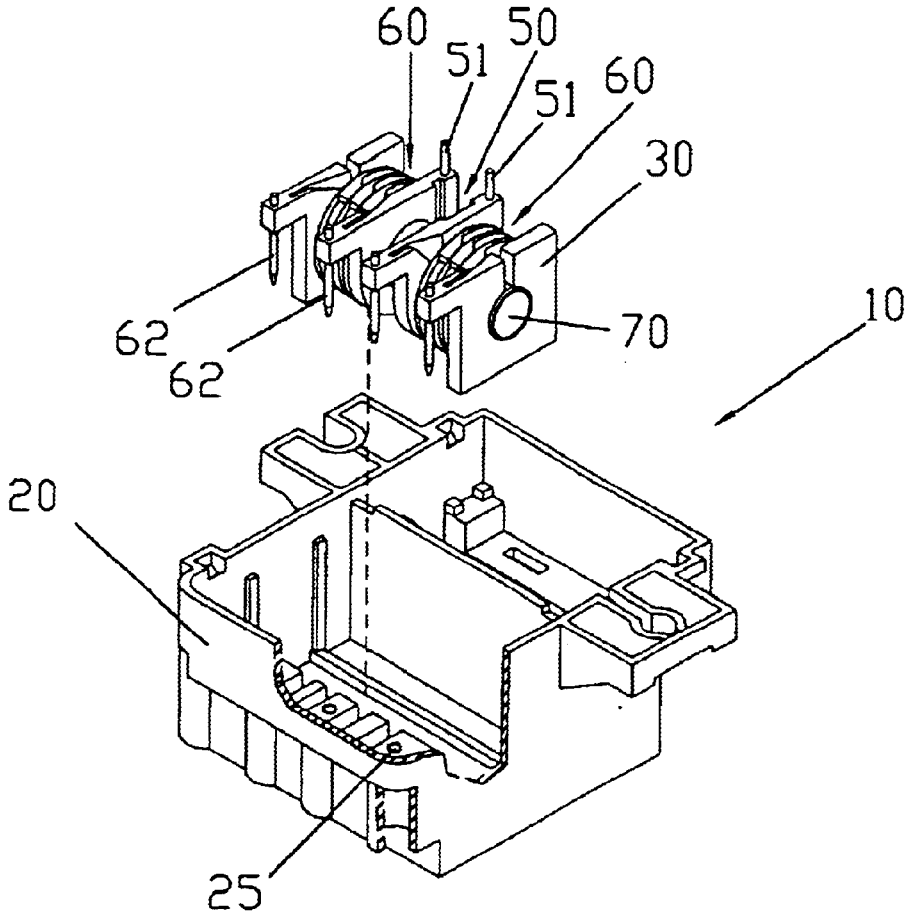
FIG. 1a (PRIOR ART)
FIG. 1*a* is a schematic view depicting a conventional ignition coil.
Figure 1B:
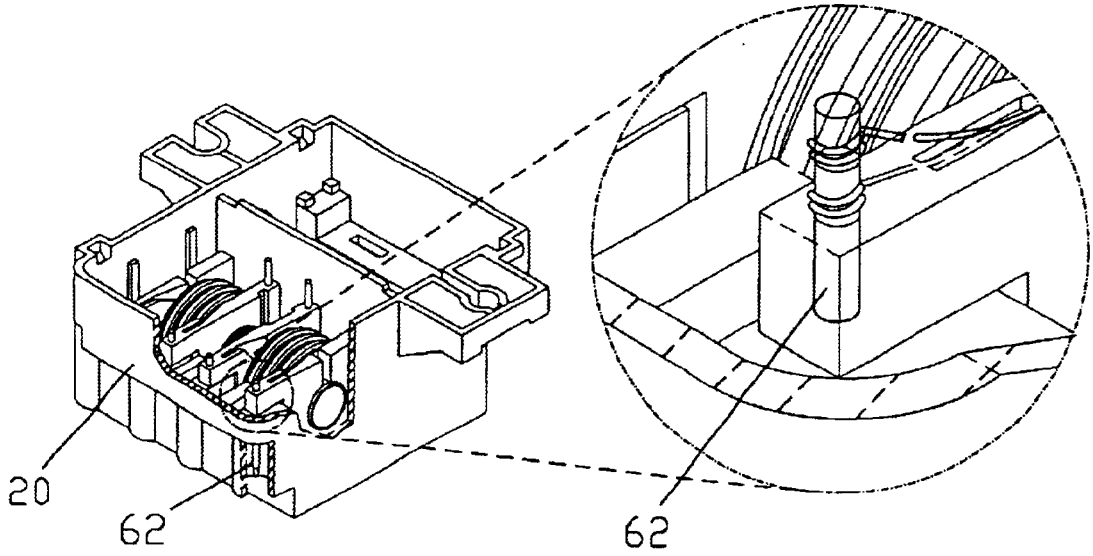
FIG. 1b (PRIOR ART)
FIG. 1*b* is an enlarged view of a pin in FIG. 1*a*.
Figure 2:
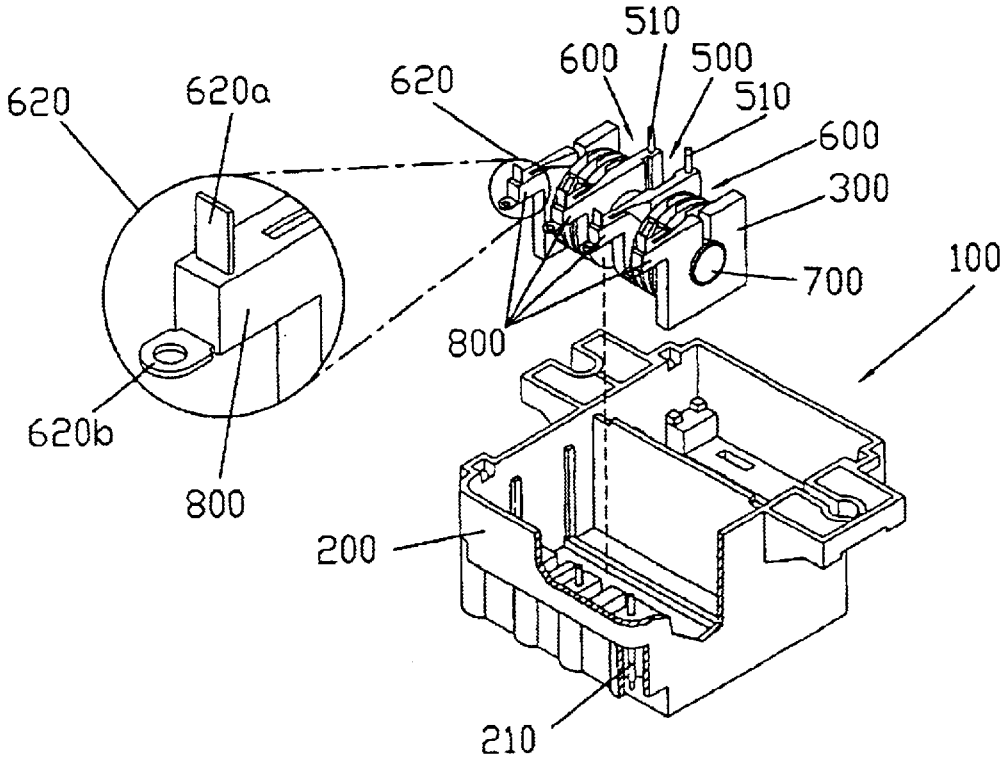
FIG. 2 is a schematic view depicting an ignition coil as disclosed in this invention.

Referring to FIG. 2, an ignition coil 100, as disclosed in this invention, comprises a casing 200, a bobbin 300, a primary coil (not shown), at least one secondary coil (not shown), a circuit (not shown) and a bar core 700. The casing 200 is made of plastic. A plurality of pins 210, made of metal, are disposed inside the casing 200.

The bobbin 300 is disposed inside the casing 200, as shown in FIG. 2. The bobbin 300 is provided with four holders 800, a primary portion 500 and at least one secondary portion 600. The primary portion 500 electrically separates the secondary portions 600. The primary portion 500 is provided with two first terminals 510. Each of the secondary portions 600 is provided with two second terminals 620 corresponding to the pins 210 respectively. Each of the second terminals 620 is provided with a protruding portion 620*a* and a ring-shaped portion 620*b*, and each of the ring-shaped portions 620*b* is abutted by the holder 800 respectively. Each of the ring-shaped portions 620*b* surrounds the corresponding pin 210 and is electrically in contact with the corresponding pin 210.

The primary coil surrounds the primary portion 500 and is electrically connected to the first terminals 510. The secondary coil surrounds the secondary portion 600 and is electrically connected to the second terminals 620. Specifically, one end of the secondary coil attaches to the protruding portion 620*a* of the second terminal 620, and the other end of the secondary coil attaches to the ring-shaped portion 620*b* of the second terminal 620, for instance, by soldering. As stated above, since the ring-shaped portion 620*b* of the second terminal 620 is formed in ring shape, each of the ring-shaped portions 620*b* surrounds the corresponding pin 210. As a result, the wire, extending from the secondary coil and attaching to the second terminal 620, is not squeezed and damaged. In addition, since the pins 210 are disposed inside the casing 200, there is no hole formed on the casing 200. Thus, there is no chance that the filled resin can leak out of the casing 200.

Further, the bar core 700 penetrates the bobbin 300 to provide a magnetic route. The circuit converts a DC voltage to a triggering-voltage signal. The triggering-voltage signal inputs to the primary coil.

In conclusion, since the pins are not squeezed, the wire is not damaged. In addition, since the pins 210 are disposed inside the casing 200, there is no chance that the filled resin might leak out of the casing 200.

While the invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. An ignition coil comprising:

a casing;

a plurality of pins embedded in the casing; and a bobbin, having a plurality of holders and a plurality of terminals corresponding to the pins respectively, disposed inside the casing, wherein each of the terminals is provided with a ring-shaped portion in contact with the corresponding pin, and each of the ring-shaped portions is abutted by the holder respectively.

2. The ignition coil as claimed in claim 1, wherein each of the ring-shaped portions surrounds the corresponding pin so as to be in contact with the corresponding pin.

3. The ignition coil as claimed in claim 2, wherein each of the terminals is provided with a protruding portion.

4. The ignition coil as claimed in claim 3, wherein the bobbin is provided with a primary portion and at least one secondary portion, and the terminals are formed on the secondary portion.

5. The ignition coil as claimed in claim 4, wherein the primary portion is provided with another two terminals.

6. The ignition coil as claimed in claim 5, further comprising:

a core disposed inside the bobbin.

7. The ignition coil as claimed in claim 6, wherein the casing is made of plastic.

8. The ignition coil as claimed in claim 7, wherein each of the pins is made of metal.

9. An ignition coil comprising:

a casing;

a plurality of pins embedded in the casing;

a bobbin disposed inside the casing and provided with a plurality of holders, a primary portion, at least one secondary portion, two first terminals formed on the primary portion, and a plurality of second terminals formed on the secondary portion, wherein each of the second terminals corresponds to the pins respectively and is provided with a protruding portion and a ring-shaped portion surrounding the corresponding pin so as to be in contact with the corresponding pin, and each of the ring-shaped portions is abutted by the holder respectively; and a core disposed inside the bobbin.

10. The ignition coil as claimed in claim 9, wherein the casing is made of plastic.

11. The ignition coil as claimed in claim 9, wherein each of the pins is made of metal.

12. The ignition coil as claimed in claim 9, further comprising a primary coil surrounding the primary portion and a secondary coil surrounding the secondary portion.

* * * * *